US008350196B2

(12) United States Patent
Buchanan

(10) Patent No.: US 8,350,196 B2
(45) Date of Patent: Jan. 8, 2013

(54) RADIO FREQUENCY ANTENNA FOR HEATING DEVICES

(75) Inventor: Shawn M. Buchanan, Tinley Park, IL (US)

(73) Assignee: TSI Technologies LLC, Wichita, KS (US)

( * ) Notice: Subject to any disclaimer, the term of this patent is extended or adjusted under 35 U.S.C. 154(b) by 1243 days.

(21) Appl. No.: 12/027,185

(22) Filed: Feb. 6, 2008

(65) Prior Publication Data

US 2009/0194526 A1 Aug. 6, 2009

(51) Int. Cl.
*H05B 6/12* (2006.01)
*H05B 6/08* (2006.01)

(52) U.S. Cl. ..... 219/620; 219/621; 219/627; 219/667

(58) Field of Classification Search ..... 219/395, 219/600, 620, 627, 667, 663–666, 494, 497; 340/572.7, 572.8, 539.27; 343/742, 787, 343/861, 867; 99/325, 451
See application file for complete search history.

(56) References Cited

U.S. PATENT DOCUMENTS

| | | | | |
|---|---|---|---|---|
| 5,608,417 | A * | 3/1997 | de Vall | 343/895 |
| 6,320,169 | B1 | 11/2001 | Clothier | |
| 6,953,919 | B2 | 10/2005 | Clothier | |
| 7,157,675 | B2 | 1/2007 | Imura | |
| 7,806,333 | B1 * | 10/2010 | McReynolds et al. | 235/450 |
| 2004/0100413 | A1 * | 5/2004 | Waldner | 343/742 |
| 2006/0017634 | A1 * | 1/2006 | Meissner | 343/742 |
| 2006/0028384 | A1 * | 2/2006 | Akiho et al. | 343/742 |
| 2006/0043198 | A1 * | 3/2006 | Forster | 340/572.7 |
| 2007/0222605 | A1 * | 9/2007 | Andresky | 340/572.7 |
| 2008/0158081 | A1 * | 7/2008 | Rofougaran | 343/787 |

FOREIGN PATENT DOCUMENTS

| | | |
|---|---|---|
| JP | 2002-359511 | 12/2002 |
| JP | 2003-242451 | 8/2003 |
| JP | 2004-364199 | 12/2004 |
| JP | 2006-294372 | 10/2006 |
| JP | 2006-344453 | 12/2006 |
| JP | 2007-134257 | 5/2007 |
| WO | 2004-071131 A2 | 8/2004 |

OTHER PUBLICATIONS

Constructing a 1000 X 600 HF Antenna Technical Application Report. Radio Frequency Identification Systems, Texas Instruments, 11-08-26-007, Aug. 2003.

International Search Report and Written Opinion dated Oct. 29. 2008 in corresponding PCT application PCT/US2008/053470 filed on Feb. 8, 2008.

* cited by examiner

*Primary Examiner* — Henry Yuen
*Assistant Examiner* — Hung D Nguyen
(74) *Attorney, Agent, or Firm* — Hovey Williams LLP

(57) ABSTRACT

An improved antenna assembly (66) designed to maintain RF communication between an object (22, 64, 148) to be heated, and a heating assembly (20, 60) such as an induction heater having a hob (34) equipped with an induction work coil (36). The antenna assembly (66) provides substantially continuous RF communication about the entirety of the hob (34), so that the object (22, 64, 148) can be rotated through substantially 360° , or displaced radially, without loss of RF communication. The preferred antenna assembly (66) includes an antenna (67) mounted upon a substrate (68) and presenting a plurality of continuous, conductive antenna loops (70, 72) oriented to cooperatively and substantially surround the hob (34).

17 Claims, 9 Drawing Sheets

RADIO FREQUENCY ANTENNA FOR HEATING DEVICES

BACKGROUND OF THE INVENTION

1. Field of the Invention

The present invention is broadly concerned with improved RF antenna assemblies used as a part of an induction or other type of heating apparatus in order to establish and maintain RF communication between the heating apparatus and an object being heated having a peripheral-mounted RF transponder. More particularly, it is concerned with such antenna assemblies, as well as overall heating systems and combinations thereof including heatable objects, making use of the improved RF antenna assemblies. The preferred RF antenna assemblies comprise multiple antenna loops cooperatively defining a substantially continuous RF communication zone outboard of a cooking hob.

2. Description of the Prior Art

Several prior art induction heating systems have been developed which use RF communications between a transmitter/receiver forming a part of the induction heater, and a radio frequency transponder (e.g., a RFID tag) associated with the object to be heated by the induction heater. Such RF communications include transponder feedback that is use by the induction heater to alter and/or control the heating of the object. The transmitter/receivers of such systems also include an antenna designed to interrogate the transponder and to receive information therefrom. The position of the antenna relative to the work coil of the induction heater in these systems is important in establishing and maintaining the necessary RF communication, and in allowing the user some freedom of placement of the object while it is being heated.

For example, U.S. Pat. No. 6,320,169, incorporated by reference herein in its entirety, describes an induction heating system having a RFID antenna located at the center of the cooking hob, i.e., in the center of the heater's work coil. In this type of system the object being heated can have a RFID tag affixed to the object's symmetry position, typically in the geometric center of the object. This symmetry position for both the RFID antenna and the RFID tag allows use of standard RFID antennas typically constructed of planar spiral or other geometric shape traces printed on a rigid substrate, with associated on-board capacitors) and other electronic components. This symmetry orientation allows the object to be heated to be rotated through a full 360 E angular orientation while atop the hob, without loss of RFID communication.

However, many heatable objects are designed to be heated to a temperature by a cooking/warming hob that exceeds the maximum operating temperature range of the RFID tag (usually 85° C., and sometimes 125° C. for microchip-based RFID tags, or possibly even higher for chipless RFID tags, resonant tag labels, planar LC resonators, printed RFID tags, or other chipless sensors such as the SENS-10, each sold by TagSense, Inc. of Cambridge, Mass.). Hence, it is often impractical to place the RFID tag or other transponder in a heatable portion of the object such as the center symmetry position. This is especially true in connection with cooking vessels or utensils, which are commonly subjected to very high heating temperatures.

One response to this problem is to mount the transponder or RFID tag on the periphery of an object subjected to high heating/warming temperatures, thereby reducing the heat load on the transponder or tag. The first known attempt to use a periphery-mounted RFID tag on a cooking vessel is described in U.S. Pat. No. 6,953,919. This patent discloses the use of a RFID tag preferentially located in the vessel's handle, remote from the heatable portion of the vessel, and thus allowing the tag to operate and survive at the ambient or slightly elevated temperatures of the vessel handle. However, this patent teaches that the RFID reader antenna can only maintain RF communication with the handle-mounted RFID tag through a limited angular rotation of the vessel. Indeed, this patent discloses that the RFID reader antenna preferably covers only a quadrant of the periphery of the work coil. Consequently, where the RFID tag is handle-mounted, the vessel must be maintained in a relatively small range of angular positions, else the necessary RF communication between the tag and reader will be lost. This presents a significant problem to the user, i.e., casual or even professional users may accidentally move the vessel handle out of the range of the RFID antenna during food preparation. Moreover, many users wish to place vessel handles in various different orientations for ease of food preparation or to ensure that a given handle is not inadvertently contacted, resulting in spillage.

Thus, designers of warming/cooking devices such as induction cooktops have recognized that the ability to allow a user to have the freedom to rotate vessel handles through a wide angular range during heating/cooking is an important feature. Attempts have been made to address this problem in several published patent applications. For instance, Japanese Publication No. 2006-344453, entitled "Heating Cooking Device" recognizes the handle placement/antenna problem, and provide the user with an aural or visual alarm which is activated if RF communications are lost between an induction cooking range antenna and the associated vessel handle-mounted RFID tag.

Japanese Publication No. 2006-294372, entitled "Heating Cooker" describes cooking systems wherein the communication area of the RFID system is varied by changing the electrified areas of the antenna. In other words, more or less of the traces of the antenna circuit are powered, based upon the stage of the cooking operation. Thus, before cooking is initiated, and before the pan handle is placed within the antenna zone, the smallest antenna area is electrified, thus making the antenna read range narrower so as to force the user to place the pan handle in the proper location relative to the electrified antenna area. Then, after cooking begins, more outlying antenna traces are electrified so as to have a wider reading area, and thus reduce the number of reading errors as the user rotates the pan handle during the cooking sequence. However, this system is inherently very complex, still only allows for RF communications over a limited portion of the periphery of the hob, and does not provide a full answer to the problem.

No known prior art describes any structure or means which provides a RF antenna forming a part of a heating device for use with cookware, servingware, or other heatable objects equipped with peripheral-mounted RF transponders, wherein the object being heated can be rotated through substantially 360° and/or radially displaced without loss of RF communication between the transponder and heating device. Accordingly, there is a real and unsatisfied need in the art for an improved antenna useful with a variety of heating devices and which establishes a substantially continuous RF communication zone outboard of and substantially surrounding the hob (s) of the heating device, thereby allowing a user to rotate an object being heated having a peripheral RF transponder to virtually any desired angular position without communication loss.

SUMMARY OF THE INVENTION

The present invention overcomes the problems outlined above and provides an RF antenna assembly normally forming a part of a heating apparatus including one or more heating hobs designed to heat an object. The antenna assembly is operable to communicate with an associated RF device peripherally coupled with the object, such as an RFID tag. Such RF communication is maintained even when the object is located at a variety of rotated or displaced positions relative to the heating hob through substantially 360° about the hob.

The preferred antenna assembly of the invention broadly includes an antenna including a plurality of continuous, conductive antenna loops oriented to cooperatively and substantially surround the heating hob, with each of the loops having an inner section proximal to said hob and defining a respective, enclosed RF communication region outboard of the inner loop section. Such zones cooperatively define a substantially continuous RF communication zone outboard of and disposed about the hob. The antenna assembly also has circuitry including at least two conductive paths adapted for coupling with a signal generator, wherein the plurality of loops each has one terminal end connected to at least one of the conductive paths, and having a second terminal end connected to at least one other of the conductive paths.

In particularly preferred embodiments, adjacent ends of the antenna loops are overlapped to cooperatively define a continuous RF communication zone outboard of and surrounding the hob. The plural, overlapped antenna loops ensure that there are no RF communication "dead zones" about the entire periphery of the hob. The antenna loops are not in electrical series, but are rather each connected to a signal generator such as a RFID reader or reader/writer. For ease of manufacture, the antenna assembly is mounted on a substrate supporting the antenna loops and associated circuitry. The substrate presents a pair of opposed faces, with at least one of the antenna loops on one of the faces, and another of the loops on the other of the faces. Alternately, all of the loops can be applied to one face of the substrate, so long as appropriate electrical connections are maintained with no series connections between the antenna loops. The antenna loops are advantageously formed as a pair of closely spaced apart, parallel copper traces. Tuning assemblies are also coupled with the loops in order to tune each of the antenna loops with reference to the signal generators driving frequency.

The antenna of the invention finds particular utility in induction heating systems for various objects including a component such as a heating hob for generating a magnetic field in order to inductively heat an object, with control circuitry operably coupled with the field-generating component in order to control the operation of the latter. Such control circuitry includes an RFID tag reader (or more preferably a RFID reader/writer) and the antenna of the invention coupled with the tag reader in order to interrogate a proximal RFID) tag associated with the object being heated, and to receive information from the object-mounted (or object-associated) RFID tag. The antenna of this invention is especially advantageous for use with induction hobs because each of its plurality of loops provides very little penetration area for magnetic field lines emanating from the induction hob. Thus, each of the plurality of antenna loops experiences very little induced voltage (noise) due to time-changing flux from the hob's alternating magnetic field, and thus the signal-to-noise ratio of each of the plurality of antennas can be very high. This lack of induced noise is a great advantage over a single loop antenna configured to fully surround the induction hob, which experiences severe induced noise.

DETAILED DESCRIPTION OF THE PREFERRED EMBODIMENT

Figure 1:
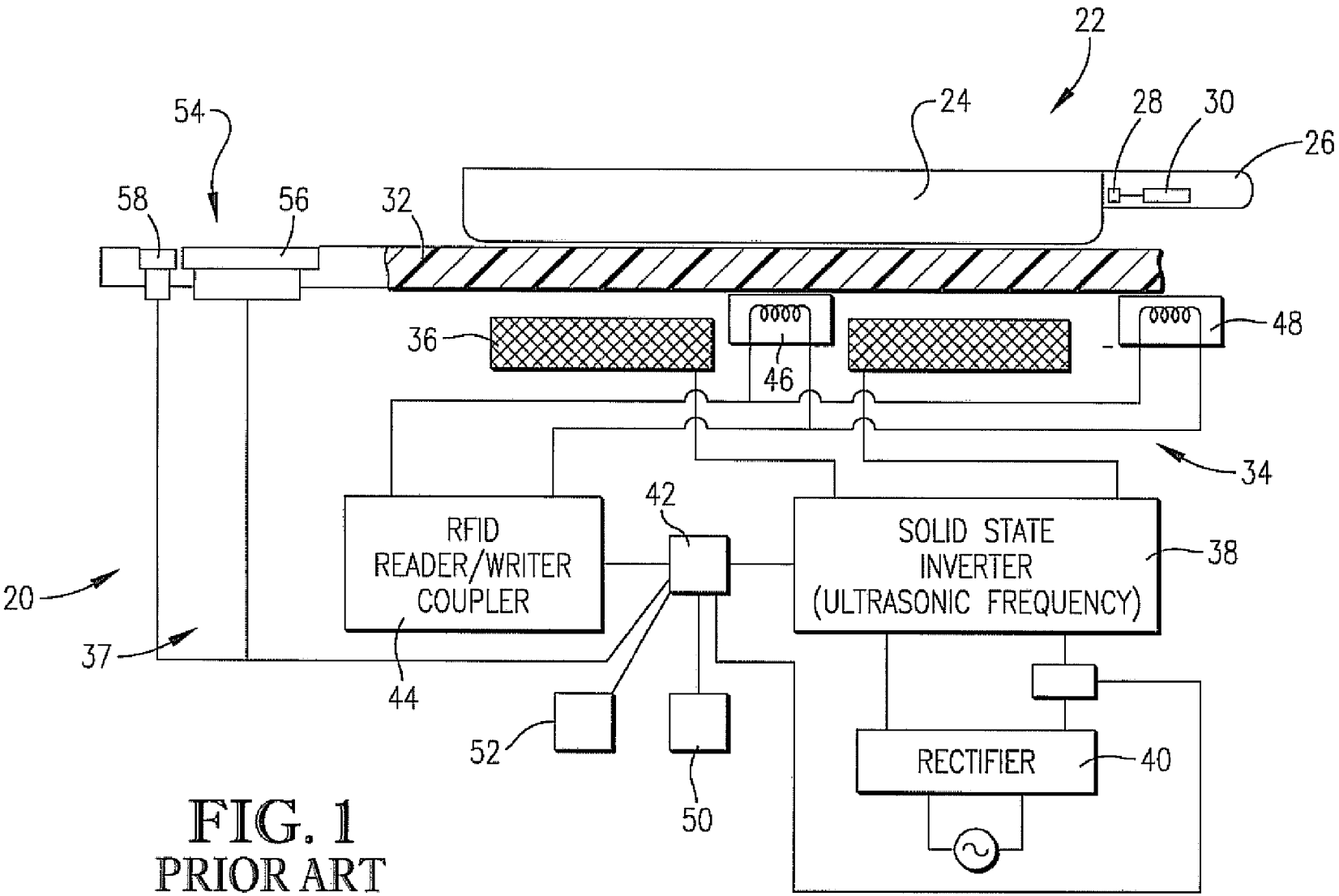
FIG. 1 PRIOR ART
FIG. 1 is a schematic side view partially in section of a prior art induction heating system as described in U.S. Pat. No. 6,953,919, illustrating a cooking vessel equipped with a peripheral, handle-mounted RFID tag, with the vessel resting atop a magnetic induction cooker in an effective cooking position wherein the vessel RFID tag is properly positioned for RF communication with a conventional quadrant-type RFID antenna forming a part of the induction cooker.
Figure 2:
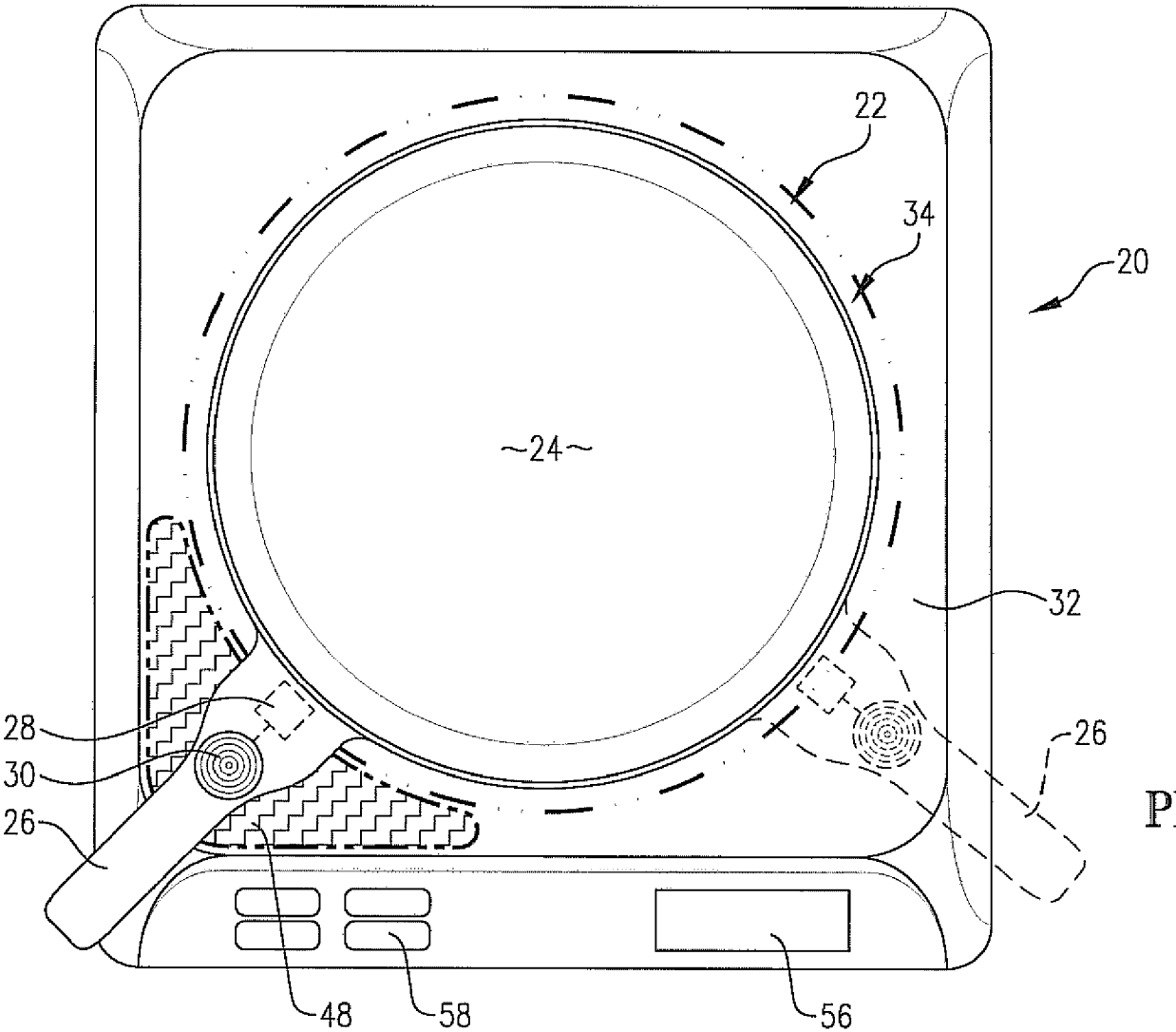
FIG. 2 PRIOR ART
FIG. 2 is a plan view of the prior art heating system illustrated in FIG. 1.

Referring first to FIGS. 1 and 2, a prior art induction heating apparatus 20 and associated heatable cooking vessel 22 are illustrated. This apparatus is of the type described in U.S. Pat. No. 6,953,919 incorporated by reference herein in its entirety.

In general, these Figures depict an exemplary RFID-equipped cooking vessel 22 in the form of a pan or skillet having a food-holding section 24 and elongated handle 26.

The handle 26 includes a resistant temperature sensing device 28 in thermal connection with the section 24, and an electrically coupled RFID tag 30.

The heating apparatus 20 includes an upper support 32 adapted to support vessel 22 as shown. The apparatus 20 also includes one or more hobs 34 having a work coil 36 and associated ultrasonic frequency inverter 38 and rectifier 40. As illustrated, the vessel 22 is positioned directly above the hob 34 and work coil 36. The overall control circuitry 37 associated with the apparatus 20 includes a microprocessor 42, a RFID reader/writer 44, and one or more RFID antennas 46, 48. Optionally, a real-time clock 50 and additional memory 52 are coupled with the microprocessor 42. In the illustrated embodiment, the control circuitry 37 also includes a user interface 54, display 56, and input device 58.

It will be seen that vessel 22 is located centrally within the confines of hob 34 and work coil 36, with antenna 48 located in a corner region at approximately a 7 o'clock position beneath the support 32 of heating apparatus 20. However, owing to the peripheral location of the RFID tag 30, only the corner-mounted antenna 48 comes into play in the illustrated embodiment and provides inductive coupling and RF communication between the vessel 22 and heating apparatus 20. This in turn means that such RF communication can only occur when the handle 26 is positioned at approximately a 7 o'clock position directly above the antenna 48, as best illustrated in fill lines in FIG. 2. On the other hand, if the vessel 22 is rotated or otherwise displaced so that the handle 26 is no longer above and within the range of the antenna 48, the necessary RF communication between the vessel 22 and apparatus 20 is lost. This is illustrated in FIG. 2 in phantom, where it will be seen that vessel 22 is rotated such that handle 26 is in approximately a 4 o'clock position, outside of the range of antenna 48. Indeed, it has been found that using typical RFID antennas in the shape of circles, ovals, or parallelograms, RF communication between the vessel 22 and apparatus 20 can only be maintained through about 45E of the full 360° about hob 34.

The apparatus 20 and vessel 22 are in RF communication for information exchange between the microprocessor 42 and RFID tag 30, when the handle 26 is substantially above the corner-mounted antenna 48. In such an orientation, the heating apparatus 20 can be controlled over a sequence of predetermined heating steps. In one particularly preferred embodiment, the heating apparatus 20 is designed to read a set of heating instructions from an external storage medium, and such instructions are used in conjunction with vessel temperature information received from RFID tag 30 during the course of vessel heating, to control the heating sequence for a particular food or recipe. Additionally, the display 56 may prompt a user to add specific ingredients to the vessel 22 to take other steps such as stirring during the course of food preparation. Of course, the RFID tag may also transmit other information such as vessel identification and vessel heating history.

Figure 3:
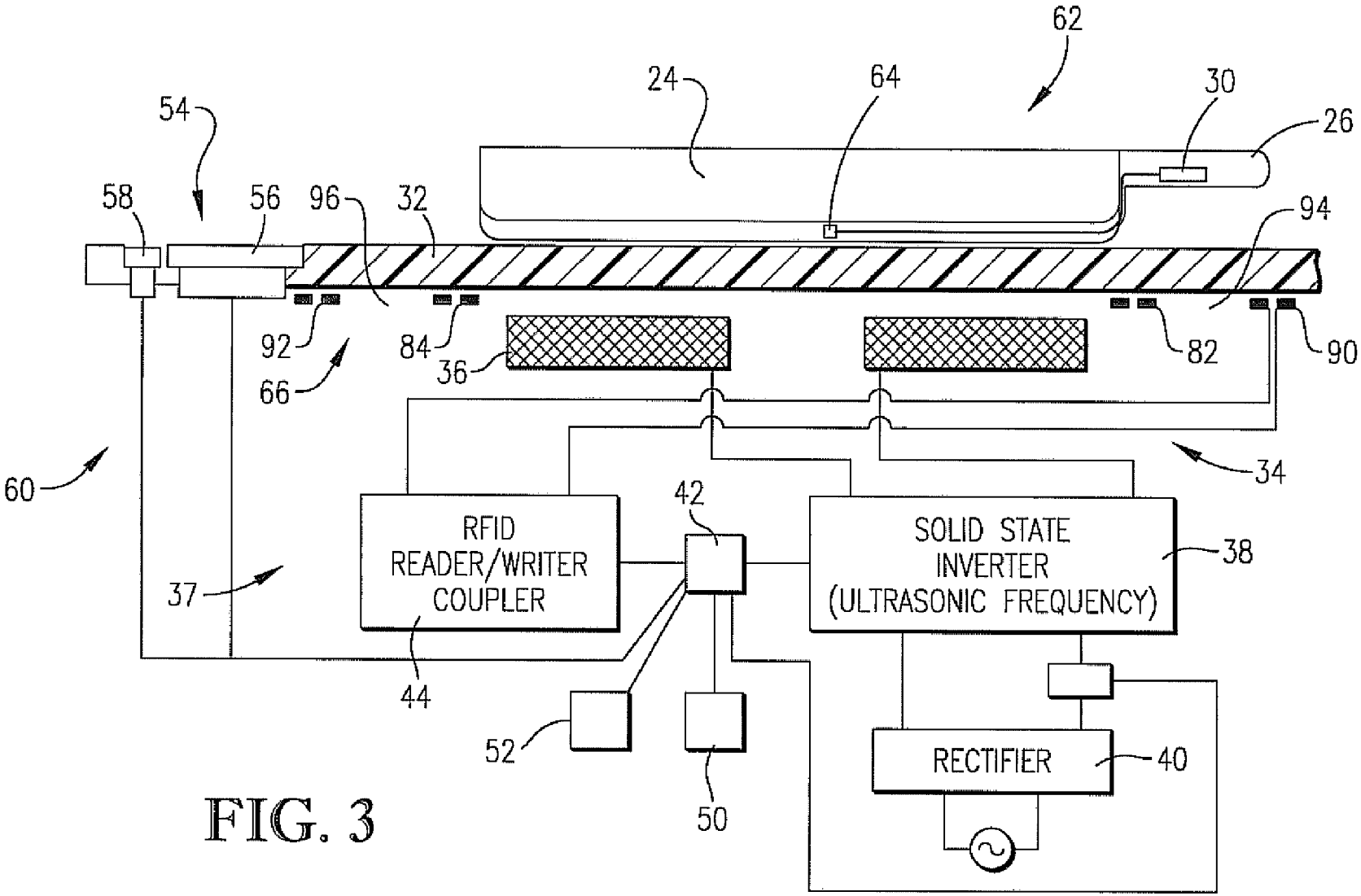
FIG. 3 is a schematic side view partially in section of an induction heating system in accordance with the invention, wherein the induction cooker is equipped with the improved RFID antenna hereof.

FIG. 3 illustrates an embodiment in accordance with the invention which is similar to that illustrated in FIG. 1, but including the improved antenna of the invention providing for substantially continuous RF communication between a heating apparatus 60 and a vessel 62, notwithstanding variations in the relative position of the vessel relative to the heating apparatus. In order to simplify the description of this embodiment, where components identical to those present in the FIG. 1 embodiment are employed, the same reference numerals are used.

Thus, the vessel 62 includes a heatable food-holding section 24 equipped with a centrally mounted temperature sensor 64, as well as handle 26 equipped with RFID tag 30 operably coupled with the sensor 64. The heating apparatus 60 includes support 32 as well as one or more hobs 34. Each hob has an induction work coil 36 and an associated inverter 38 and rectifier 40. The control circuitry 37 likewise includes microprocessor 42 and a RFID reader/writer 44 operably coupled with the antenna assembly 66 of the present invention. Again, a real-time clock 50 and added memory 52 are optionally coupled with microprocessor 42. The heating apparatus 60 and vessel 62 can be operated in the manner of apparatus 20 and vessel 22 as previously described, or in any desired fashion making use of RF communication between the tag 30, reader/writer 44, and microprocessor 42.

Figure 5:
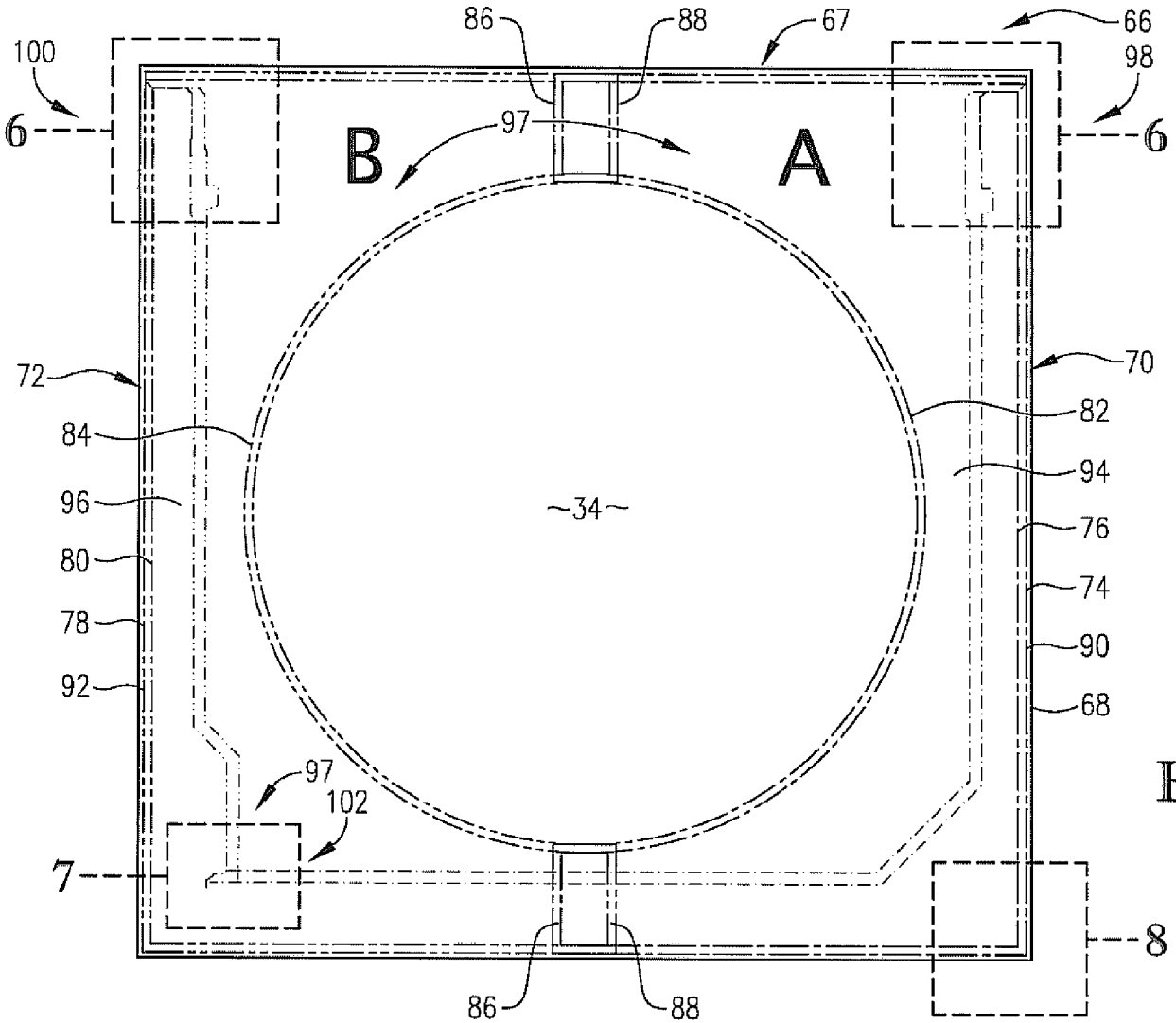
FIG. 5 is a plan view of a preferred RF antenna in accordance with the invention and illustrating an antenna-supporting substrate and the positioning of the side A and B half antenna traces on opposite sides of the substrate.
Figure 8:
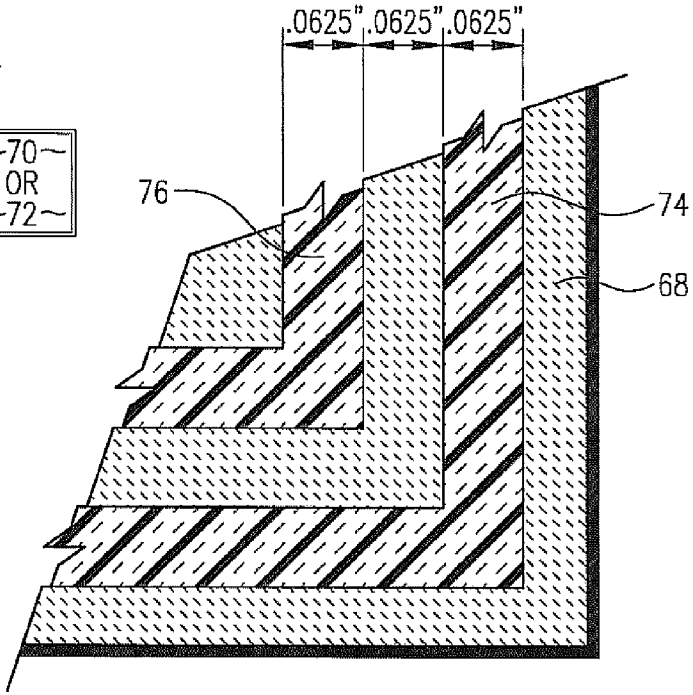
FIG. 8 is an enlarged, fragmentary view of the antenna traces schematically illustrated in FIG. 5 as box 8.

The preferred antenna assembly 66 of the invention is best illustrated in FIGS. 5-9. This antenna assembly includes a multiple loop antenna broadly referred to by the numeral 67. The antenna 67 is supported on a non-conductive, plate-like synthetic resin substrate 68 (e.g., printed circuit board material such as FR4), and is in the form of a plurality (here two) continuous, conductive antenna loops 70, 72 respectively defining half antenna loops A and B (FIG. 5). In this design the half loop 70 is formed on the upper face of substrate 68, while the half loop 72 is formed on the opposed, lower face thereof. Each such half loop is formed by a pair of closely spaced, copper tracings 74, 76 and 78, 80, which may be applied in any conventional manner such as by etching, electroplating, or sputtering. As illustrated in FIG. 8, the tracings 74, 76 of half loop 70 are each 0.0625 inches in width and are spaced apart a similar distance. It will also be seen that each of the half loops 70, 72 include an arcuate inner section 82 and 84, as well as opposed, straight segments 86 and 88 extending outwardly from the respective sections 82 and 84, and generally straight C-sections 90 and 92 interconnecting the outboard ends of the segments 86 and 88. In this fashion, the inner sections 82 and 84, the segments 86 and 88, and the segments 90 and 92, define respective, enclosed RF communication regions 94 and 96 outboard of the inner arcuate sections 82 and 84. Moreover, the half loops 70, 72 are oriented to cooperatively and substantially surround the hob 34. In the illustrated embodiment, the adjacent ends of the half loops 70, 72 near the segments 86, 88 are overlapped, thereby defining a completely continuous RF communication zone outboard of and completely surrounding the hob 34. Preferably, the arcuate sections 82 and 84 are located slightly outboard of the outer periphery of hob 34, so as to minimize noise in the antenna circuitry and undue heating of the antenna. Normally, the sections 82 and 84 are located to cooperatively create an inner antenna diameter about one-half inch greater than the diameter of the hob.

Figure 6:
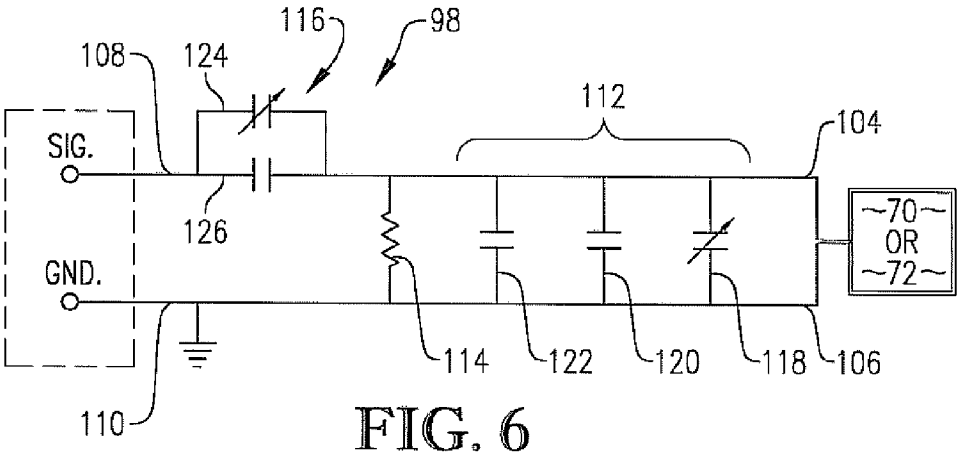
FIG. 6 is an enlarged view of the portions of the antenna circuitry schematically depicted in FIG. 5 as boxes 6.
Figure 7:
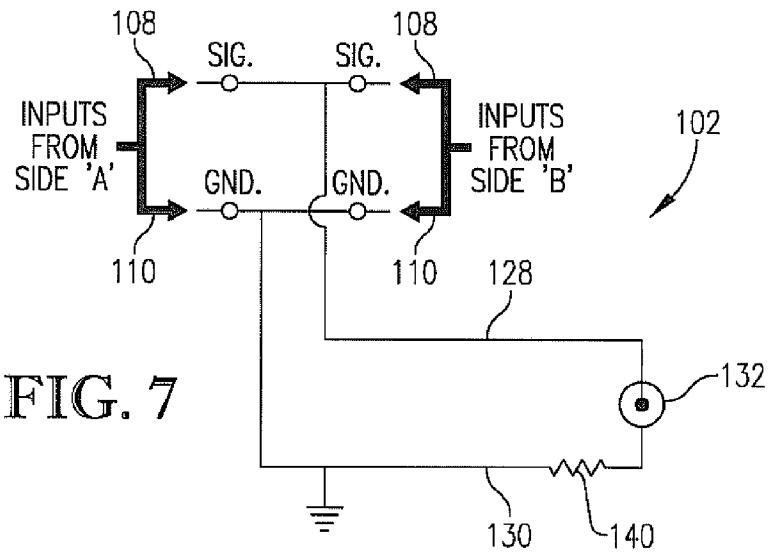
FIG. 7 is an enlarged view of the portion of the antenna circuitry schematically depicted in FIG. 5 as box 7.

The connection of half loops 70, 72 to the RFID reader/writer 44 is preferably effected through the use of antenna circuitry 97 including a pair of identical tuning assemblies 98 and 100, as well as a terminal network 102. Specifically, each of the antenna halves 70, 72 has a pair of terminals respectively referred to as signal and ground terminals 104, 106 extending from the traces 74, 76 and 78, 80. These terminals are connected to respective leads 108, 110 including an individual assembly 98 or 100. The assembly 98 is illustrated in FIG. 6 includes a first capacitor assembly 112, a resistor 114, and a second capacitor assembly 116. The assembly 112 preferably includes a variable capacitor 118, as well as two fixed capacitors 120, 122, all of the capacitors 118-122 being in parallel. The second capacitor assembly 116 likewise includes a variable capacitor 124 and a fixed parallel capacitor 126 coupled with signal lead 108. The preferable equivalent capacitance of first capacitor assembly 112 for operation with a RFID reader/writer operating at 13.56 MHz is 3.9 pico Farads, with at least 50V operating voltage rating. The preferable equivalent capacitance of second capacitor assembly 116 for operation with a RFID reader/writer operating at 13.56 MHz is 20 pico Farads, with at least 50V operating voltage rating. The preferable resistance value of resistor 114 for operation with a RFID reader/writer operating at 13.56 MHz is somewhere in the range of a low of 0.47 ohm to a high of open circuit, where the value of this resistor is directly proportional the Q-factor of the circuit. The higher the resistor value 114, the higher the Q-factor of the respective half loop antenna. This high Q-factor can be beneficial for long read range capability. Although current models of the antenna of this invention use no resistor 114 on the circuit, thus giving resistor 114 an open circuit value and hence a maximum Q-factor, a smaller resistance value 114 can be used to lower the Q-factor to allow for less read range at ideal temperature conditions but more effective operation of the antenna of this invention in variable temperature environments where the variable temperature of the antenna circuit components can vary their effective values and thus the tuning of the antenna, thereby making a lower Q-factor antenna more capable of effective operation over a wide range of operating temperatures than an antenna with a high Q-factor.

The signal and ground leads 108, 110 from the respective half loop antennas 70, 72 (or sides A and B) are operably coupled with network 102. This network includes a pair of signal and ground leads 128, 130 connected to reader/writer 44 via connector 132. The network 102 has a resistor 140, in series electrical connection with ground lead 130. The value of this resistor 140 determines the attenuation of the antenna circuit, where a zero ohm resistance provides no attenuation and a higher value of resistance 140 provides output power attenuation if necessary so as to prevent saturation of an RFID tag used with this antenna. Although current models of the antenna of this invention use a zero ohm, ¼ watt resistor 114, any resistance value up to several Kohms may be employed to attenuate the output power of the connected reader. The maximum operating power of the resistor should reflect the output power of the reader being used with the antenna of this invention. When connecting antenna assembly 66 of this invention to the reader/writer 44 via connector 132, it has been found that the coaxial cable from the reader/writer 44 should pass through the center of a ferrite toroid two to four times (forming two to four loops of wire around the toroid) enroute to the connector 132 so as to act as a common mode choke to help the overall performance of the RFID system (see, Constructing A 1000×600 HF Antenna Technical Application Report, Lit. Number 11-08-26-007, Texas Instruments, 2003, incorporated by reference herein.) The ferrite toroid acts as an impedance matching component that balances the RF lines between the antenna assembly 66, the reader/writer 44, and the coaxial cable itself and reduces "reading holes" in the antenna's field area. A ferrite toroid with part number 5943000301 from the Fair-Rite Corporation has proven itself optimum in this application.

Figure 9:
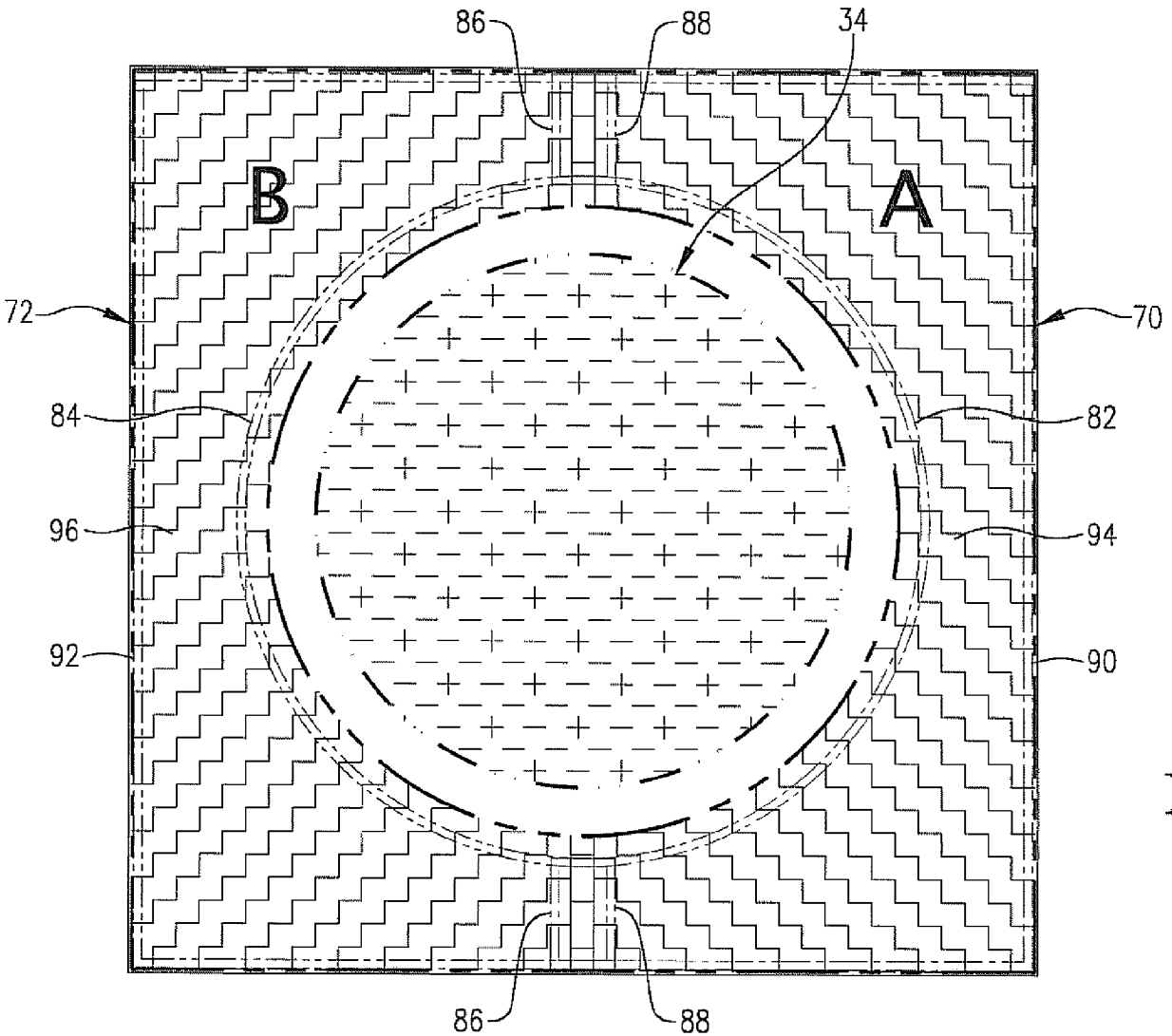
FIG. 9 is a plan view similar to that of FIG. 5, but illustrating the magnetic flux lines of an induction cooking work coil surrounded by the antenna of the invention, and also the RF communication zone outboard of the work coil established by the improved antenna of the invention.

As indicated in FIGS. 3 and 5, the antenna assembly 66 of the invention permits continuous RF communication between RFID tag 30 and reader/writer 44 notwithstanding the angular position of the vessel handle 26. FIG. 9 illustrates this operational feature. Thus, in FIG. 9, an induction hob 34 is depicted and the electromagnetic flux therefrom is illustrated with "–+–" hatching. Also, the surrounding RF communication zone cooperatively defined by the half loops 70, 72 is illustrated in diagonal stairstep hatching. Thus, so long as RFID tag 30 carried by handle 26 is substantially above this RF communication zone, effective communication between the tag 30 and reader/writer 44 is maintained. At the same time, there is a relatively high signal to noise ratio with the antenna assembly 66.

Figure 10A:
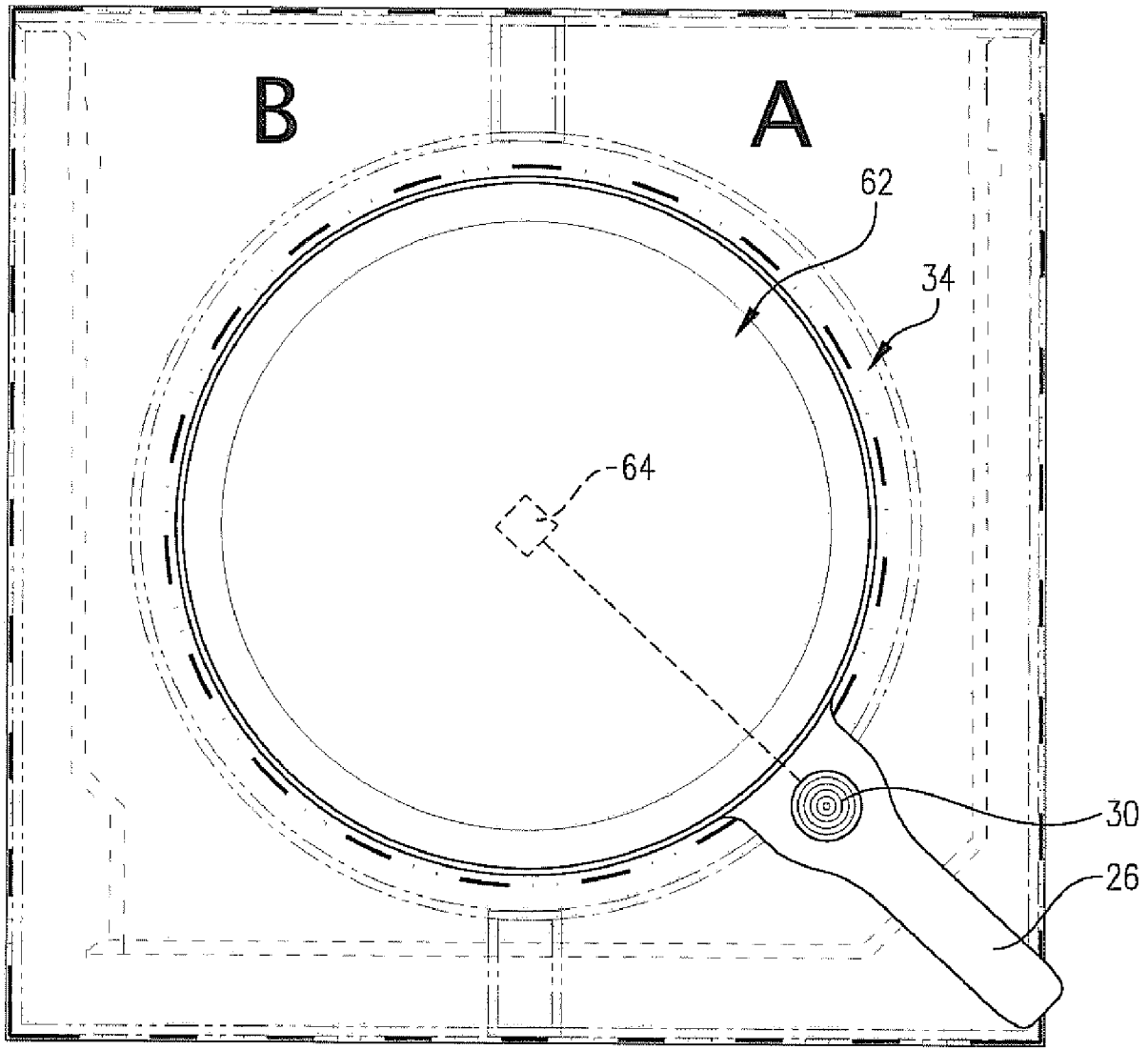
FIG. 10*a* is a plan view illustrating placement of a pan having a central temperature detector and handle-mounted RFID tag located centrally on the cooking hob of an induction cooker and further illustrating the position of the antenna hereof relative to the hob and pan.
Figure 10B:
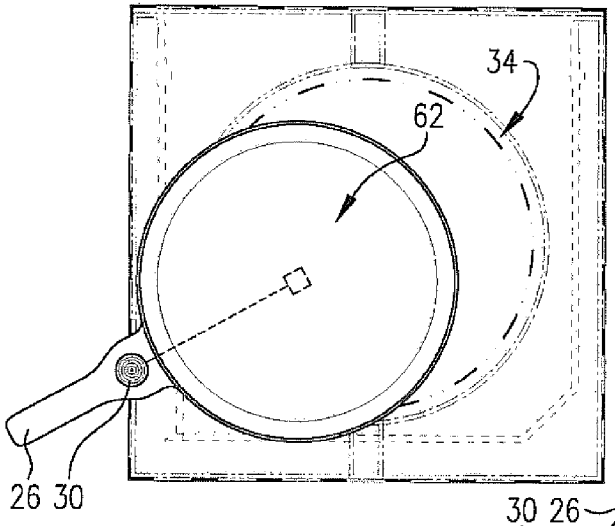
FIG. 10*b* is a view similar to that of FIG. 10*a*, but illustrating the pan in a radially displaced orientation relative to the cooking hob, while nonetheless maintaining RF communication between the handle-mounted RFID tag and the antenna.
Figure 10C:
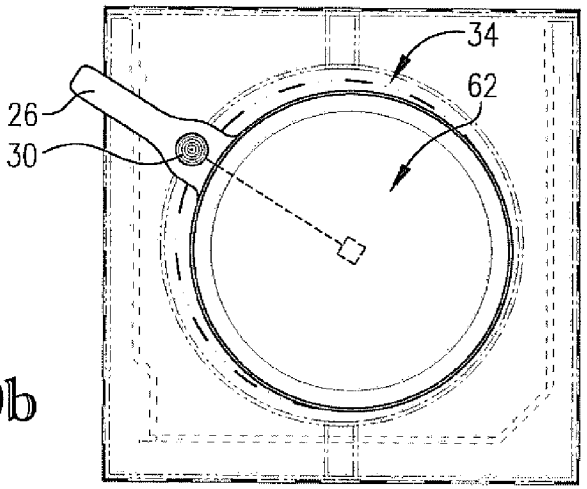
FIG. 10*c* is a view similar to that of FIG. 10*a*, but illustrating another offset pan orientation which still maintains RF communication between the handle-mounted RFID tag and the antenna.
Figure 10D:
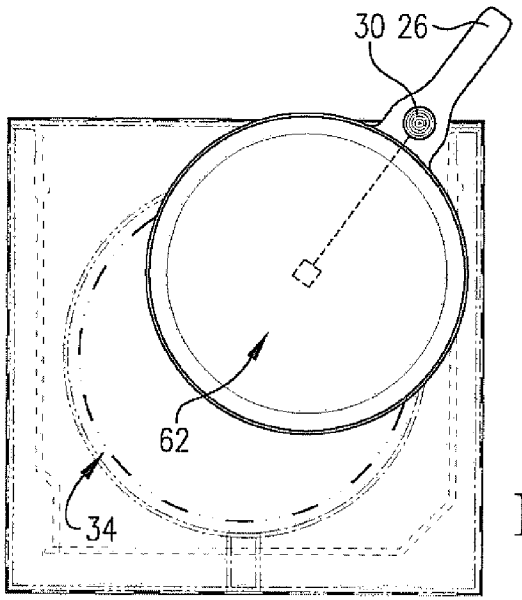
FIG. 10*d* is a view similar to that of FIG. 10*a*, but illustrating another offset pan orientation which still maintains RF communication between the handle-mounted RFID tag and the antenna.
Figure 10E:
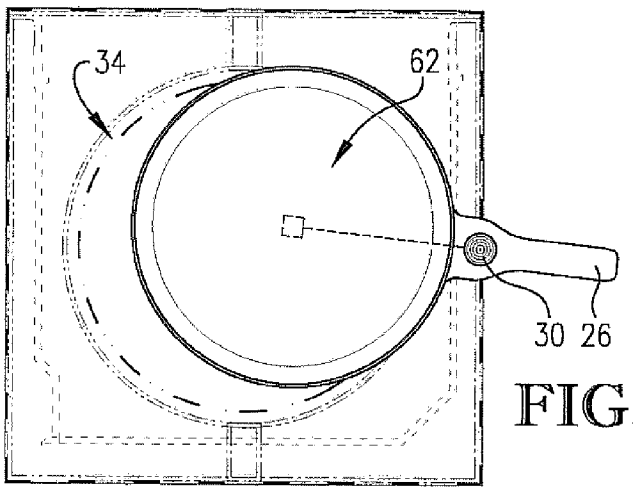
FIG. 10*e* is a view similar to that of FIG. 10*a*, but illustrating another offset pan orientation which still maintains RF communication between the handle-mounted RFID tag and the antenna.

FIG. 10*a* illustrates the placement of vessel 62 on an induction hob 34, with the handle 26 located at approximately a 4 o'clock position. As illustrated, this vessel orientation establishes RF communication between the tag 30 and reader/writer 44. FIGS. 10*b* through 10*e* illustrate other pan/heating apparatus relative orientations which still maintain such RF communication. Thus, the vessel 62 can be displaced radially relative to the hob 34 over relatively large distances without breaking the RF communication. Generally, so long as approximately one half of the effective communication area presented by RFID tag 30 is above the RF communication regions 94 and 96 established by antenna assembly 66, RF communication will be maintained.

In the foregoing discussion, the invention has been described in the context of induction heating hobs and cooking vessels such as pans or pots. However, the invention is not so limited. For example, the antenna of the invention may also be used in connection with other types of cooking/warming hobs, e.g., gas, radiant, electric resistive, or halogen hobs. Further, the antenna can be used with other types of inductively coupled RF reader/transponder systems.

Figure 4:
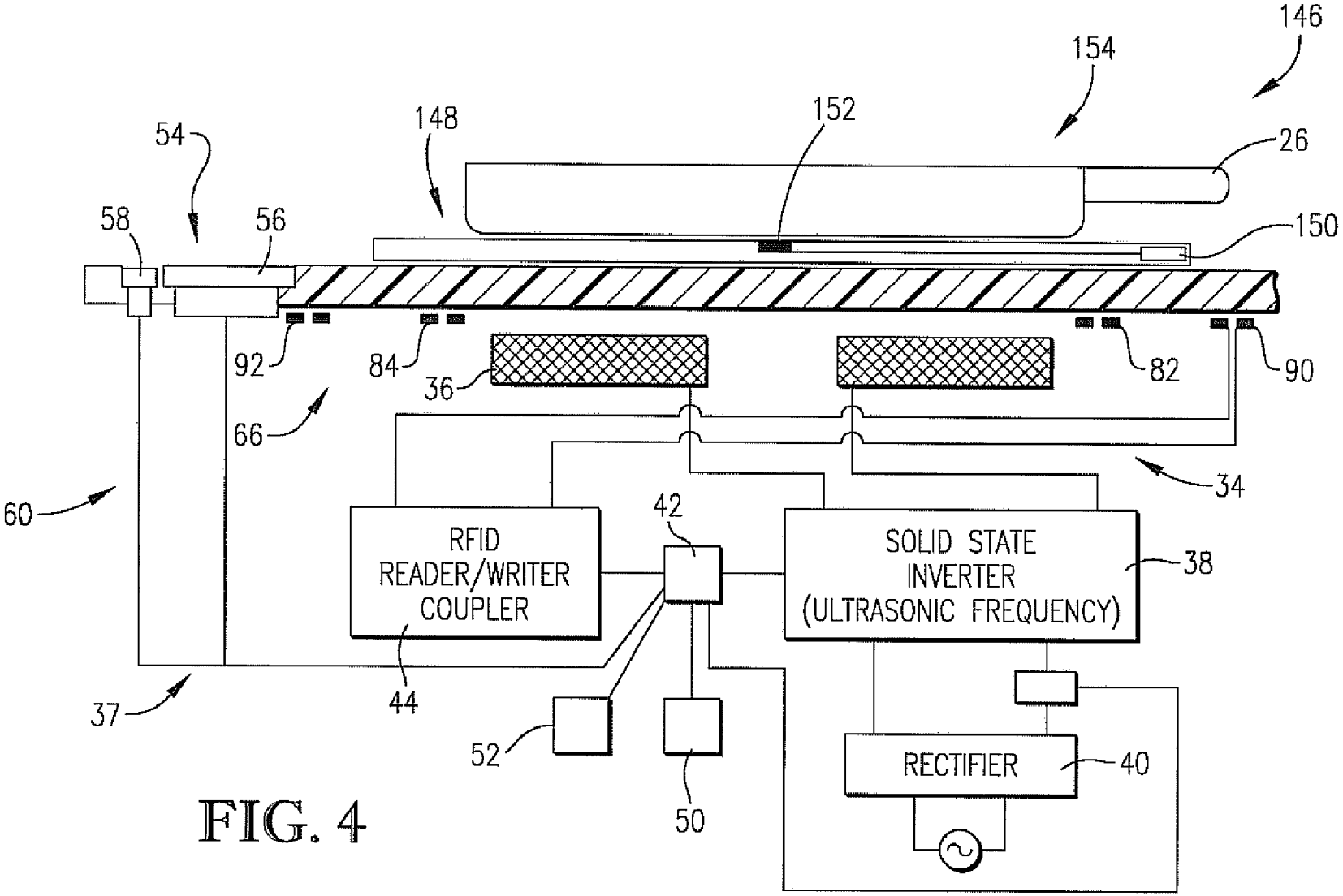
FIG. 4 is a schematic side view partially in section of an induction heating system wherein an intermediate trivet is positioned between the upper surface of the induction cooker and a pan to be heated, wherein the trivet is equipped with a temperature sensor and RFID tag and the induction cooker includes the improved antenna of the invention.

FIG. 4 illustrates a heating apparatus 60 identical to that depicted to that in FIG. 3 (and thus identical reference numerals are used throughout) in conjunction with another type of vessel assembly 146. The assembly 146 includes a trivet 148 equipped with a peripheral RFID tag 150 and a central temperature sensor 152 operably coupled with the tag 150. A conventional vessel 154, such as a pan or skillet, is positioned atop trivet 148 such that the sensor 152 may continuously monitor the temperature of the vessel. In this system, the RF communication between tag 150 and reader/writer 44 serves to control the heating of the vessel 152 via temperature feedback from the sensor 152 attached to the removable trivet 148 but still associated with the vessel 152. This illustrates that the invention can be used for establishing RF communication when heating virtually any type of object equipped with a peripheral RFID tag or the like.

I claim:

1. An induction heating system comprising:

a component for generating a magnetic field in order to inductively heat an object, said component presenting a heating hob, said magnetic field creating a magnetic flux zone through the heating hob;

control circuitry operably coupled with said field generating component in order to control the operation of the component, including an RFID tag reader and an antenna coupled with the RFID tag reader in order to interrogate a proximal RFID tag associated with said object, and to receive information from said RFID tag, said antenna including a plurality of continuous, conductive antenna loops oriented to cooperatively and substantially surround said heating hob, each of said antenna loops having an inner section proximal to said heating hob and defining a respective, enclosed RF communication region outboard of said inner antenna loop section, said RF communication regions cooperatively defining a substantially continuous RF communication zone located in outwardly spaced relationship from said magnetic flux zone and disposed about the heating hob; and circuitry including at least two conductive paths coupled with said RFID tag reader, said plurality of antenna loops each having one terminal end connected to at least one of said conductive paths, and having a second terminal end connected to at least one other of said conductive paths, in order to operably couple the RFID tag reader with said antenna, the spacing between said magnetic flux zone and said RF communication zone permitting very little penetration of magnetic flux into the RF communication zone.

2. The induction heating system of claim 1, said component comprising an induction work coil.

3. The induction heating system of claim 1, adjacent ends of said antenna loops being overlapped to cooperatively define a continuous RF communication zone outboard of and surrounding said heating hob.

4. The induction heating system of claim 1, including a substrate supporting said antenna loops and presenting a pair of opposed faces, at least one of said antenna loops on one of said faces, and another of said antenna loops on the other of said faces.

5. The induction heating system of claim 1, there being a pair of said antenna loops.

6. The induction heating system of claim 1, said antenna loops each formed of a pair of closely spaced apart, parallel copper traces.

7. The induction heating system of claim 1, one of said conductive paths being a signal input path from a signal generator, and another of said paths being a ground path.

8. The induction heating system of claim 1, said antenna loop inner sections being arcuate in configuration.

9. The combination comprising:

an induction heater including a component for generating a magnetic field, said component presenting a heating hob, said magnetic field creating a magnetic flux zone through the heating hob; and control circuitry operably coupled with said field generating component in order to control the operation of the component; and an induction heatable object having a periphery and positioned over said heating hob in order to be heated by said component, and an RFID tag operably coupled with said periphery of said object, said control circuitry including an RFID tag reader and a multiple loop antenna coupled with the RFID tag reader in order to interrogate said RFID tag and to receive information from said RFID tag, said antenna defining a substantially continuous RF communication zone located in outwardly spaced relationship from said magnetic flux zone and disposed about said heating hob in order to establish RF communication between said RFID tag and said RFID tag reader, the spacing between said magnetic flux zone and said RF communication zone permitting very little penetration of magnetic flux into the RF communication zone, whereby said object may be rotated to a plurality of respective positions through substantially 360 degrees of rotation while maintaining said RF communication zone between said RFID tag and said RFID tag reader.

10. The combination of claim 9, said antenna comprising:

a plurality of continuous, conductive antenna loops oriented to cooperatively and substantially surround said heating hob, each of said antenna loops having an inner section proximal to said heating hob and defining a respective, enclosed RF communication region outboard of said inner antenna loop section, said RF communication regions cooperatively defining a substantially continuous RF communication zone outboard of and disposed about the heating hob; and circuitry including at least two conductive paths adapted for coupling with a signal generator, said plurality of antenna loops each having one terminal end connected to at least one of said conductive paths, and having a second terminal end connected to at least one other of said conductive paths.

11. The combination of claim 10, one of said conductive paths being a signal input path from a signal generator, and another of said paths being a ground path.

12. The combination of claim 9, said induction heatable object being a food heating vessel.

13. The combination of claim 9, adjacent ends of said antenna loops being overlapped to cooperatively define a continuous RF communication zone outboard of and surrounding said heating hob.

14. The combination of claim 9, including a substrate supporting said antenna loops and presenting a pair of opposed faces, at least one of said antenna loops on one of said faces, and another of said antenna loops on the other of said faces.

15. The combination of claim 9, there being a pair of said antenna loops.

16. The combination of claim 9, said antenna loops each formed of a pair of closely spaced apart, parallel copper traces.

17. The combination of claim 9, said antenna loop inner sections being arcuate in configuration.

* * * * *